US005407199A

United States Patent [19]

Gumina

[11] Patent Number: 5,407,199

[45] Date of Patent: Apr. 18, 1995

[54] INTERACTIVE GAMES AND METHOD OF PLAYING

[75] Inventor: Anthony G. Gumina, Las Vegas, Nev.

[73] Assignee: Vegas Pull Tabs, Inc., Las Vegas, Nev.

[21] Appl. No.: 68,343

[22] Filed: May 28, 1993

[51] Int. Cl.[6] ..... A63F 3/06; A42D 15/00

[52] U.S. Cl. ..... 273/139; 273/138 R; 283/901; 283/903

[58] Field of Search ..... 273/139, 138 R, 240; 283/103, 101, 901, 903

[56] References Cited

U.S. PATENT DOCUMENTS

| | | | |
|---|---|---|---|
| 1,527,929 | 2/1925 | Simons | 273/139 |
| 3,826,499 | 7/1974 | Lenkoff | 273/240 |
| 4,491,319 | 1/1985 | Nelson | 273/1 |
| 4,634,149 | 1/1987 | Donovan | 283/102 |
| 4,740,016 | 4/1988 | Konecny | 283/903 |
| 4,943,090 | 7/1990 | Fienberg | 273/139 |
| 5,037,099 | 8/1991 | Burtch | 273/139 |
| 5,046,737 | 9/1991 | Fienberg | 273/139 |
| 5,092,598 | 3/1992 | Kamille | 273/139 |
| 5,118,109 | 6/1992 | Gumina | 273/139 |

FOREIGN PATENT DOCUMENTS 2075918 11/1981 United Kingdom ..... 273/139

OTHER PUBLICATIONS

Scarne's Encyclopedia of Games by John Scarne "Holdém", Harper & Row Publishers, p. 26, 1973.

*Primary Examiner*—Benjamin H. Layno
*Attorney, Agent, or Firm*—Shlesinger Arkwright & Garvey

[57] ABSTRACT

Interactive games provide a player with an opportunity to use skill and knowledge of conventional game strategy to facilitate greater player interest. The games described herein include simulated versions of blackjack, draw poker, Hold'Em, pick seven and roulette which are playable on video display terminals, scratch-off cards or pull tab cards interchangeably. Each casino game described herein has been modified for use with the card and video format to provide a simulated game which incorporates the strategy of the related casino game.

7 Claims, 6 Drawing Sheets

| FINAL HAND | PRIZE-5 CARDS | PRIZE-6 CARDS | PRIZE-7 CARDS |
|---|---|---|---|
| TWO PAIR | $5 | $2 | NO PRIZE |
| THREE OF A KIND | $10 | $5 | TICKET |
| STRAIGHT | $25 | $10 | $2 |
| FLUSH | $50 | $25 | $5 |
| FULL HOUSE | $100 | $50 | $10 |
| FOUR OF A KIND | $500 | $250 | $100 |
| STRAIGHT FLUSH | $1,000 | $500 | $250 |
| ROYAL FLUSH | $10,000 | $5,000 | $1,000 |

| FINAL HAND | PRIZE-5 CARDS | PRIZE-6 CARDS | PRIZE-7 CARDS |
|---|---|---|---|
| TWO PAIR | $5 | $2 | NO PRIZE |
| THREE OF A KIND | $10 | $5 | TICKET |
| STRAIGHT | $25 | $10 | $2 |
| FLUSH | $50 | $25 | $5 |
| FULL HOUSE | $100 | $50 | $10 |
| FOUR OF A KIND | $500 | $250 | $100 |
| STRAIGHT FLUSH | $1,000 | $500 | $250 |
| ROYAL FLUSH | $10,000 | $5,000 | $1,000 |

INTERACTIVE GAMES AND METHOD OF PLAYING

FIELD OF THE INVENTION

This invention relates to games involving player selection based upon known games rules and simulates luck of the draw found in common card games and roulette.

BACKGROUND OF THE INVENTION

Previously known card games using a standard 52 card deck as well as common casino gambling games such as roulette, craps and even slot machines have been simulated through the use of ticket games. The patent of Kamille U.S. Pat. No. 5,092,598 shows several typical examples. However, until my U.S. Pat. No. 5,118,109, no prior games involved the use of traditional game rules in the selection process. In my prior instant poker game card, U.S. Pat. No. 5,118,109, incorporated herein by reference the player had the opportunity to exchange each one of the original cards dealt with one other card. However, any skill requirement was reduced since the alternative values for each card were predetermined. For example, when one card of the hand was replaced with another card, the new value received was not similar to a card being drawn from a deck, but each card value had a corresponding replacement card value.

Simulation of being dealt a replacement card from a deck add more realism to the game and heightens player interest. Furthermore, nearly always having a chance to have a winning ticket gives the player the feeling that they can control winning and losing to some extent.

In view of the foregoing, it can be seen that there is a need for a new interactive game and method through the use of opaque coatings on paper substrates, pull tab cards and video display terminals which can more closely imitate the intricacies of known casino gambling games.

OBJECTS AND SUMMARY OF THE INVENTION

An important object of the invention is to provide a new game format which involves strategy and simulates traditional game format conditions.

Another object of the invention is to provide a new game format for playing traditional games of twenty-one, Hold'Em, seven card stud, draw poker and roulette.

Another object of the invention is to provide a game format which can be used in video display terminals, pull tab games, and in scratch-off tickets.

The foregoing drawings will be described in greater detail with respect to the detailed description of the preferred embodiments discussed below.

DETAILED DESCRIPTION OF THE INVENTION

Simulated Blackjack Game

Figure 1:
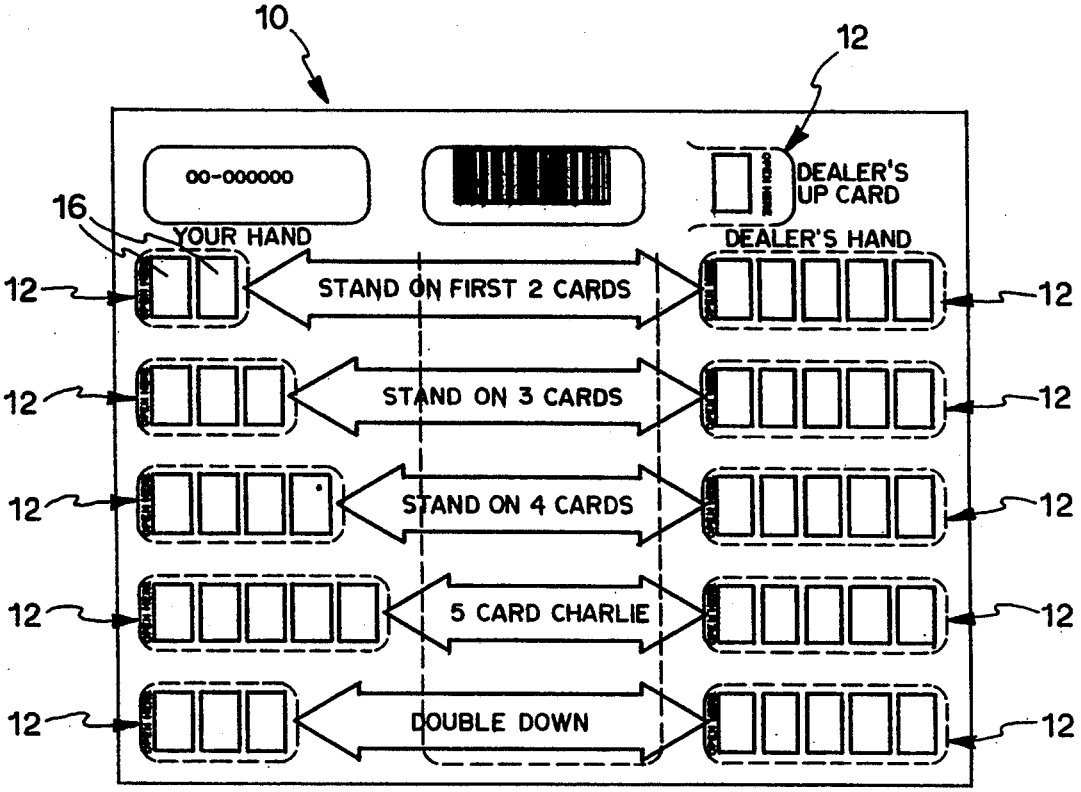
FIG. 1 is a game simulating apparatus simulating the game of twenty-one.
Figure 2:
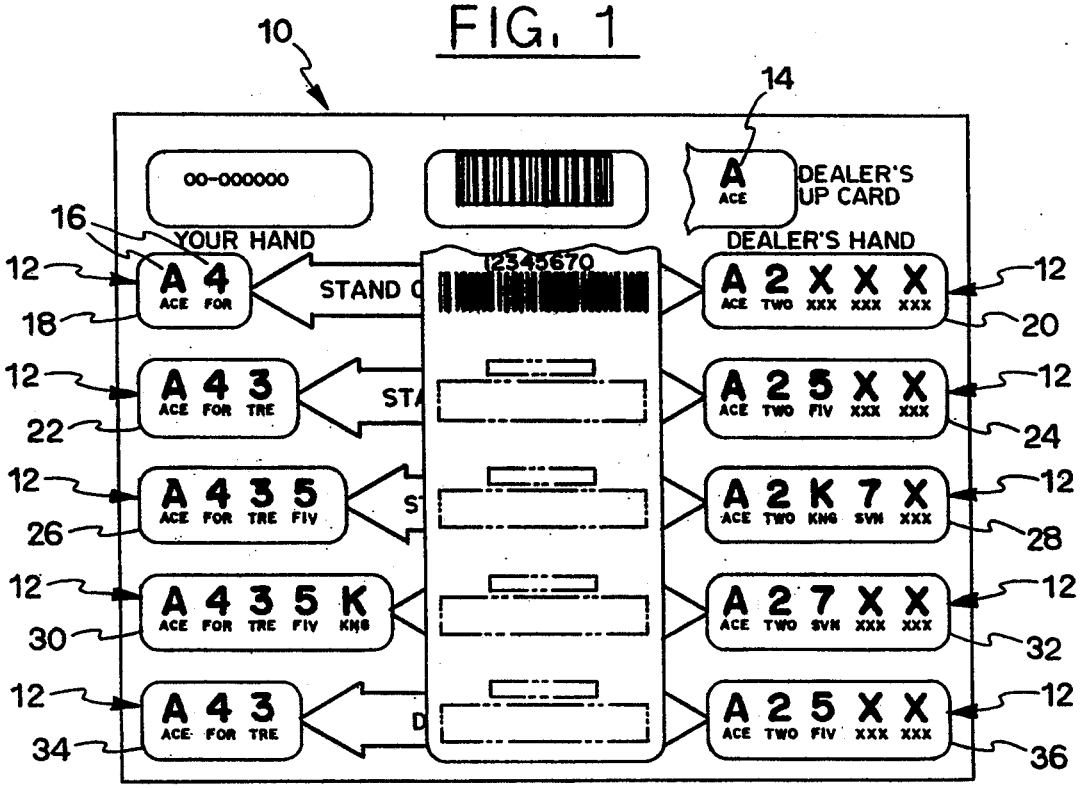
FIG. 2 shows the game simulating apparatus of FIG. 1 with hand values revealed.

FIG. 1 shows a game simulating apparatus 10 for playing the game blackjack or twenty-one. The game simulating apparatus 10 includes preferably a plurality of areas 12 for displaying representative card hand values or the like. The game simulating apparatus 10 could either be a card having pull tabs initially covering the areas 12 could have opaque scratch off material covering the areas 12, or the game simulating apparatus 10 could be a video display terminal having a view screen and areas 12 located on the screen. In case of a video display terminal, the areas 12 may be indicated at the outset or the screen could remain blank or monochromatic until a proper button is pushed. Preferably, the screen would have touch sensors so that selections could be made by actual touching of the screen using known technologies or by pressing buttons on a control panel.

The simulated blackjack game is initiated by revealing the dealer's up card at area 14 and the player's hand at area 16. The area 16 designated as player's hand or your hand would include two card values which are shown by way of example as an ace-four combination 18 while the dealer's up card is shown as an ace. At this point the player has the option of standing on the ace-four combination 18 or selecting another card. If the player elects to stand, then the dealer's hand displayed at area 20 showing the dealer's down card displayed having a value of two. Since the dealer would lose if the player stood on the ace four, the dealer would draw another card which is indicated at area 26 as a three thus giving the dealer sixteen and a winning hand over the fifteen showing in the player's hand.

However, if the player elects to draw an additional card identified in area 16, the player would have card values of ace, four and three for a total of eight or eighteen, depending on whether the ace was valued at one or eleven. Going over to the dealer's hand designated at area 24, the dealer would no longer receive the ace, two, three combination since the player was dealt a three the dealer would then receive a new card when he dealt his hand to himself and would receive, for example, ace, two, five, giving the dealer eighteen and thus tying with the player's hand shown in area 22.

However, should the player not elect to stand on eighteen, the player may also select an additional card as shown in area 26. The additional card would be a five so that the player would have an ace, four, three and five combination adding up to thirteen. Since the dealer would no longer receive the five card as noted in area 24, the dealer would now receive a different card, in this case a king giving the dealer thirteen and since the dealer cannot stand below sixteen the dealer would have to take another card which in this case would be a seven and would then have twenty and have a winning hand.

Should the player have not elected to stand on thirteen, the player could elect to draw an additional card which in this case would be the king and the player would bust. Now referring to area 32, the dealer's hand would now not receive the king and the dealer would only receive the seven for a hand of twenty.

The game simulating apparatus 10 may also include the option to double down in a game of twenty-one which is an opportunity to double your bet and receive one additional card as shown at area 34. In this instance the dealer's card hand would be the same as the situation where the player stood on three cards. In practice the double bet would be paid to the game sponsor prior to revealing of the player's double down combination 34. When a video display terminal is used the machine would require a double bet in order to select the double down option.

As can be seen, a basic feature of the game is that the player's choice of how many cards to receive affects the choice of cards the dealer will receive. In practice, this means that the player will select his hand, decide when to stand and then by scratching off an area 12 or removing a pull tab or revealing an area on the video display screen as the case may be, the dealer's hand opposite the player's stand will be revealed. As soon as the dealer's hand is played, the game is over. If the player reveals more than one of the dealer's hands, the card is void. However, this occurrence could be electronically prevented in a video version of the game.

In the pull tab or scratch off versions of the game, control indicia are preferably used on the cards in order to provide security for the game. Control indicia may either be numbers, letters, bar codes and the like.

Hold'Em

Figure 3:
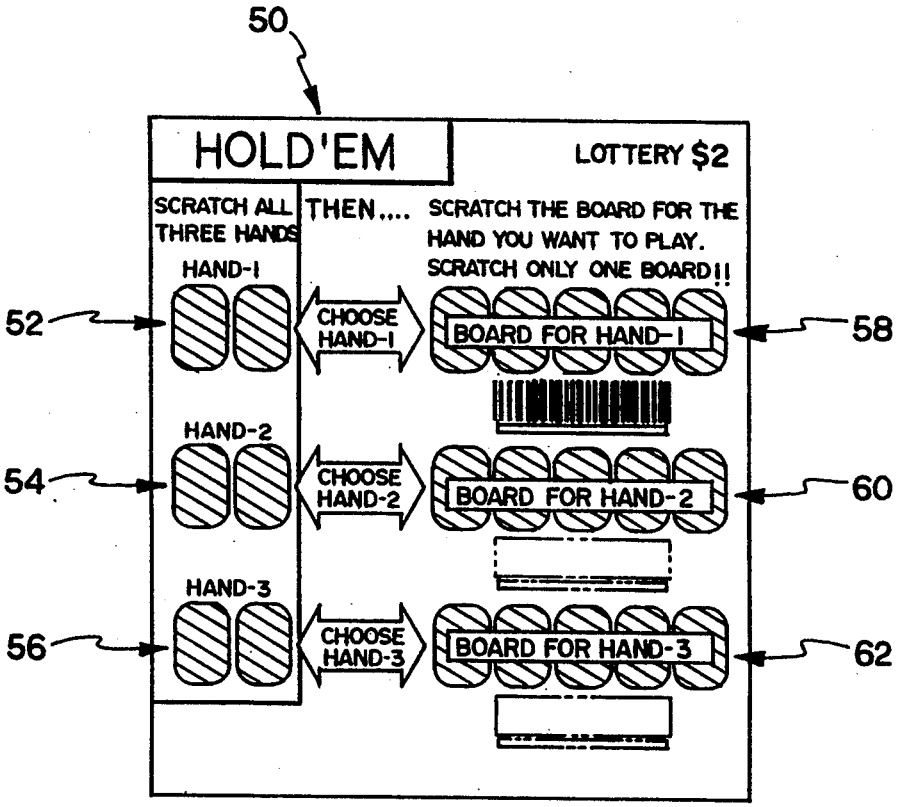
FIG. 3 shows a game simulating apparatus for the game "Hold'Em"
Figure 4:
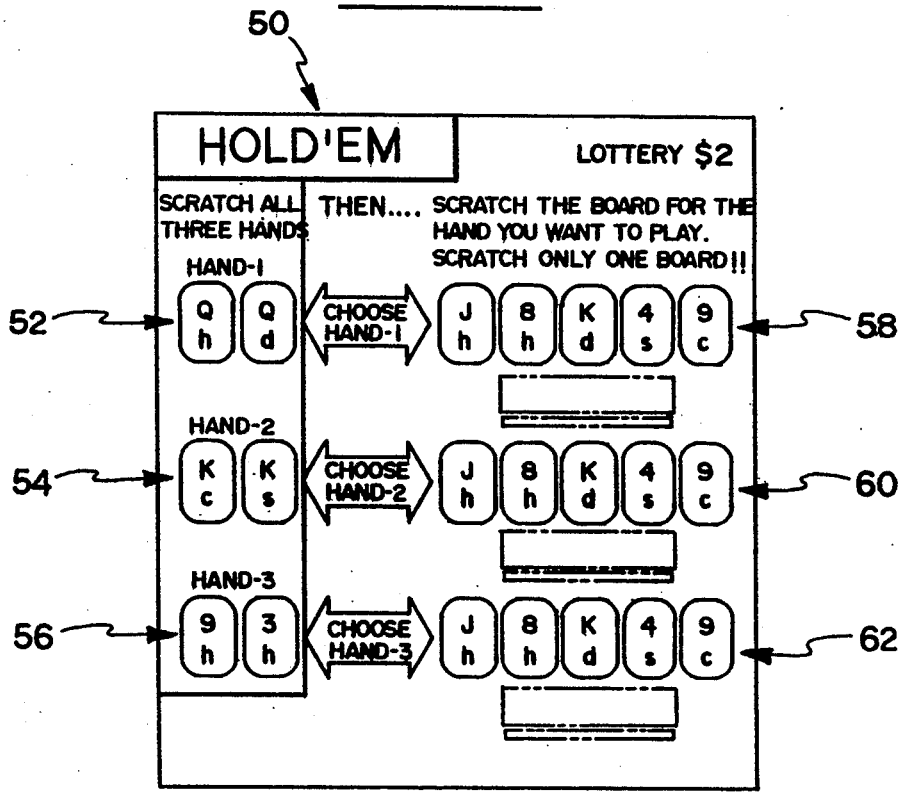
FIG. 4 is the game simulating apparatus of FIG. 3 having all hands revealed.

FIGS. 3 and 4 refer to another game called "Hold-'Em". The game simulating apparatus 50 which could be a scratch off game, a pull tab game or could be played on a video display terminal. The game is played as follows: As shown in FIGS. 3 and 4, the player receives preferably three initial hands, each being displayed in a separate display area 52, 54 and 56, respectively. According to the display device used for playing the game, each of the player's hands displayed in areas 52, 54 and 56 may be revealed by either electronic means using the video display terminal, or if the game is played on a card for example, the values can be hidden beneath scratch off material or pull tabs. Upon revealing the values for each of the hands, one hand is selected and the corresponding board hidden at corresponding display areas 58, 60 and 62 is revealed.

Now looking at FIG. 4, each of the representational hands or display areas 52, 54 and 56 are revealed. After review of the value of those hands, it can be seen that display area 52 indicates a pair of queens. Display area 54 reveals a pair of kings and display area 56 reveals a nine and three of hearts. Based on evaluation of these three hands, the player then selects one board corresponding to one of the hands so that the highest possible poker hand values can be obtained when the card values displayed on one of the boards are added to the selected hand value. As can be seen in FIG. 4, the board values are all identical in that the resulting poker hand will be representational of five cards being added to the selected hand as they would have been had they been drawn from a deck. As can be seen if a player would have selected the hand displayed at area 54, then the player would have three kings which would be the highest possible choice. After selecting the highest choice on the apparatus 50, the player receives a corresponding prize.

Draw Poker

Figure 5:
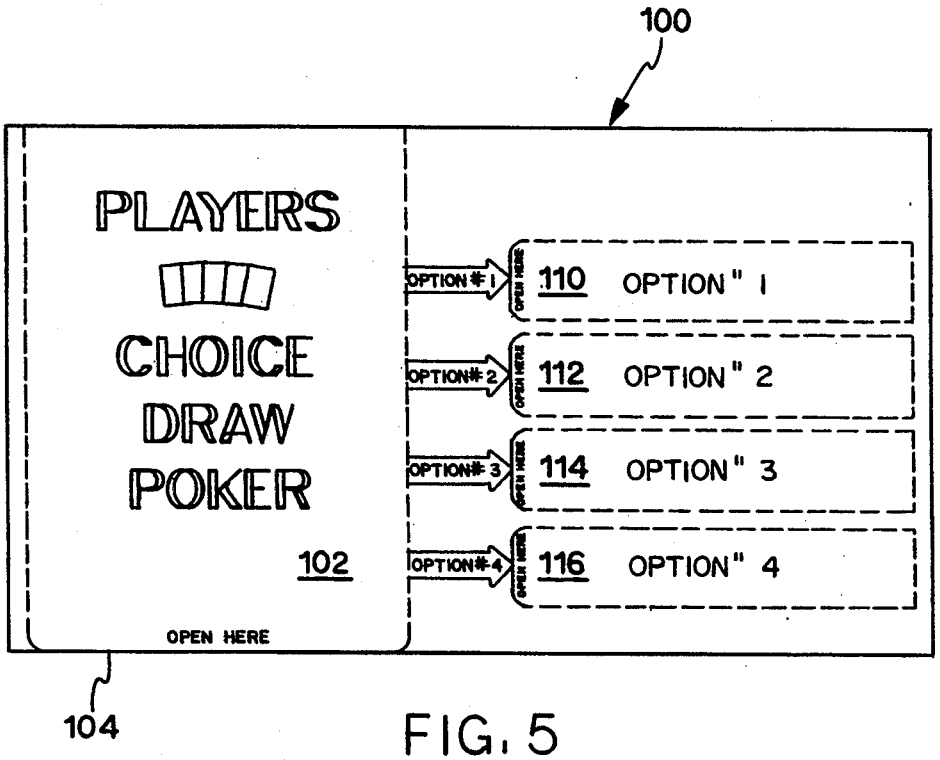
FIG. 5 is a game simulating apparatus for the game "Draw Poker"
Figure 6:
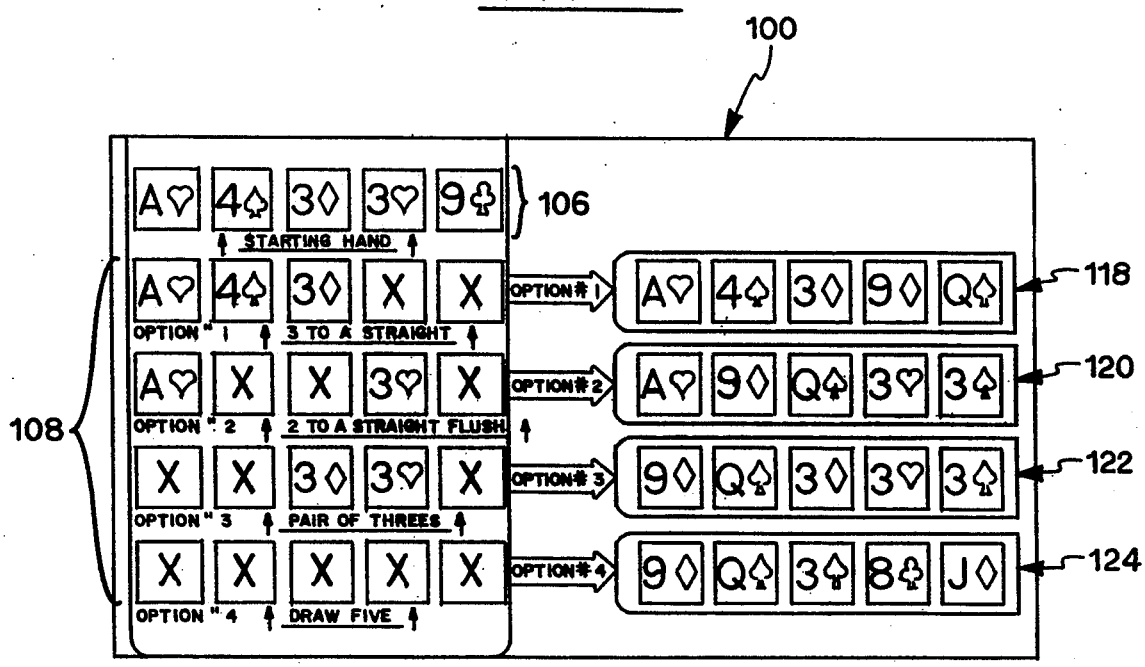
FIG. 6 shows the game simulating apparatus of FIG. 5 with all hands revealed.

FIGS. 5 and 6 show a game simulating apparatus 100 in the form of a pull tab card or ticket. It should be understood that this game also could be played with a scratch off material or with a video display terminal. In the pull tab game as shown, the game is initiated by lifting flap 102 from the bottom 104 to reveal the underlying starting hand 106 as well as the option field 108. Flap 102 could be replaced by opaque scratch off material, or in the case of a video display terminal, could merely be a display area that is revealed upon initiation of the game program. Referring back to FIG. 5, flaps 110, 112, 116 and 118 reveal a preferred number of option hands corresponding to the option field 108. In FIG. 6, all of the pull tabs 110, 112, 114 and 116 have been removed from the corresponding display areas 118, 120, 122 and 124. Each of the options have been revealed for simplification purposes, however when the game is actually played only one option will be revealed and revealing more than one option will void the ticket. With a video display terminal, possibilities of inadvertent player error are avoided, by electronically prohibiting improper play.

In order to play the game the player reviews the starting hand 106 and then makes a selection of one of the remaining options in the option field 108. After deciding which values to keep and which to discard, an option is selected which will provide replacement card values for those discarded. The new card values added will be received as though they were drawn from a deck, regardless of which card values were discarded. For example, in FIG. 6, with reference to the option display areas 118, 120, 122 and 124, the first replacement value would simulate being drawn a nine of diamonds from a card deck. The second replacement value drawn would simulate a queen of spades, the third replacement value drawn would be a three of spades, the fourth replacement value drawn would be an eight of clubs and the fifth replacement would be a jack of diamonds. However, if only three card values were discarded, then the player would only have added the nine of diamonds, the queen of spades, and the three of spades to the player's hand. Therefore, if the player selected option three and retained the pair of threes he would receive as new card values; the nine of diamonds, the queen of spades and the three of spades so that the player would now have 3 threes in the hand. The object being to obtain the highest poker hand.

Pick Seven

Figure 7:
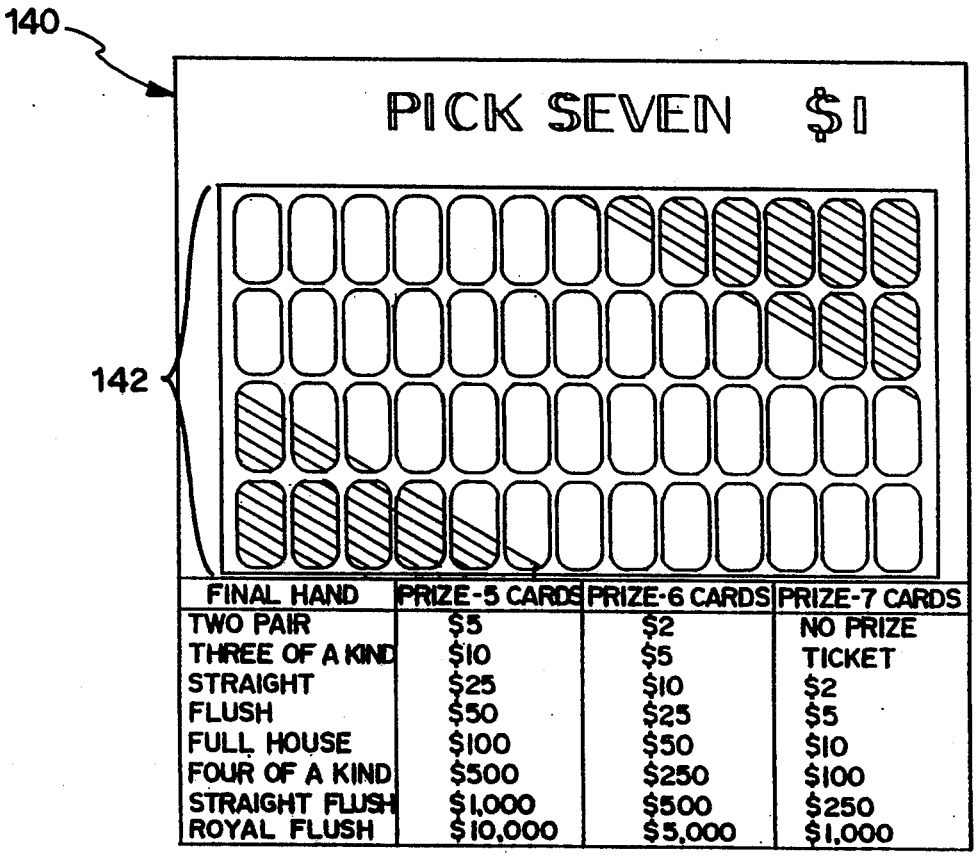
FIG. 7 shows a game simulating apparatus for playing the game "Pick Seven"
Figure 8:
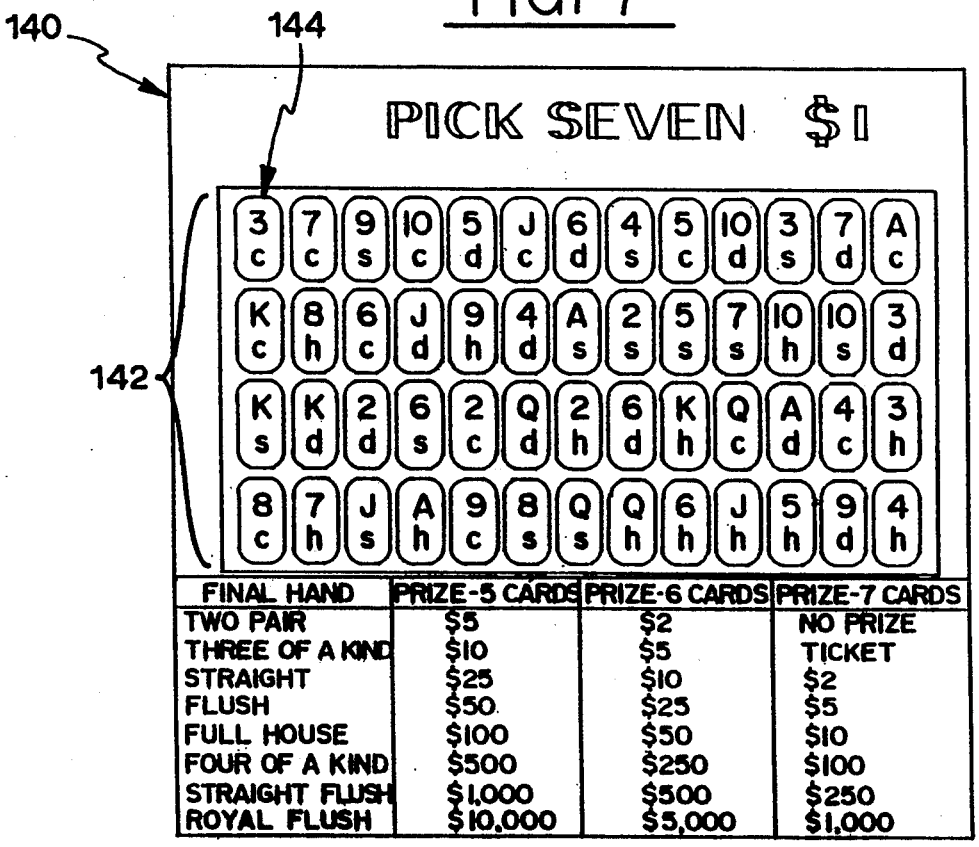
FIG. 8 shows the game simulating apparatus of FIG. 7 with all choices revealed.

FIGS. 7 and 8 show a game display apparatus 140 in which the player selects a poker hand from fifty-two card values randomly displayed on a defined display area 142 by uncovering individual representational values 144. This game could also be played on a scratch off ticket, as a pull tab game or on a video display terminal. The game is played by selecting five cards initially in an attempt to produce a winning poker hand. After selecting five card values, the player has the option to select one or two additional card values in an attempt to improve his hand over that obtained with selecting five card values. For example, if a player selects five card values and obtains two pairs, he then may elect to redeem his hand for five dollars or the player may elect to try to obtain a full house and if the next card selected produces a full house, the player will increase his take to $50.00. However, if the next card drawn does not produce a full house, he will have reduced his payoff to $2.00. If the player then proceeds to select another card and obtains a full house then he will receive a take of $10.00, but if the selection of seven card values only produces two pairs he receives no prize. It should be understood that other prizes or prize values may be awarded, the prize values shown are for exemplary purposes only.

Roulette

Figure 9:
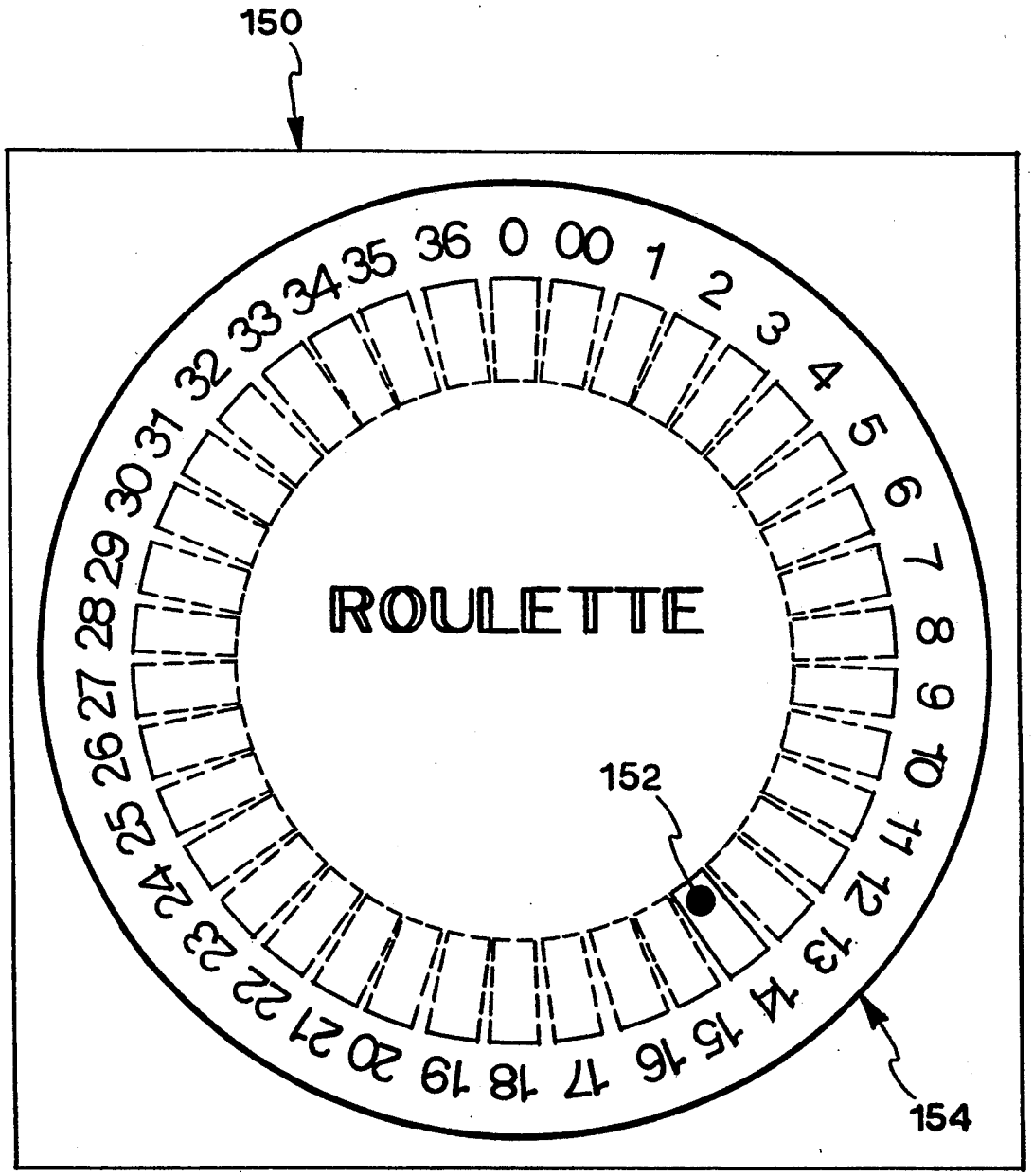
FIG. 9 shows a game simulating apparatus for playing roulette.

FIG. 9 shows a game display apparatus 150 for simulating the game of roulette. In this simulated game version a simulated ball representation 152 is located at one of the numbers on the simulated roulette wheel 154. The game is played by allowing the player to reveal one number in the hopes of locating the ball representation 152. In order to increase player interest, the player will be awarded other chances to reveal the hidden ball 152 with defined prize values. Preferably, the player will be given up to five chances to uncover the ball representation 152 with descending payoff amounts. If the player is unsuccessful then the player is given the option to attempt to uncover all other numbered areas without uncovering the ball representation 152 in order to win a prize.

Figure 10:
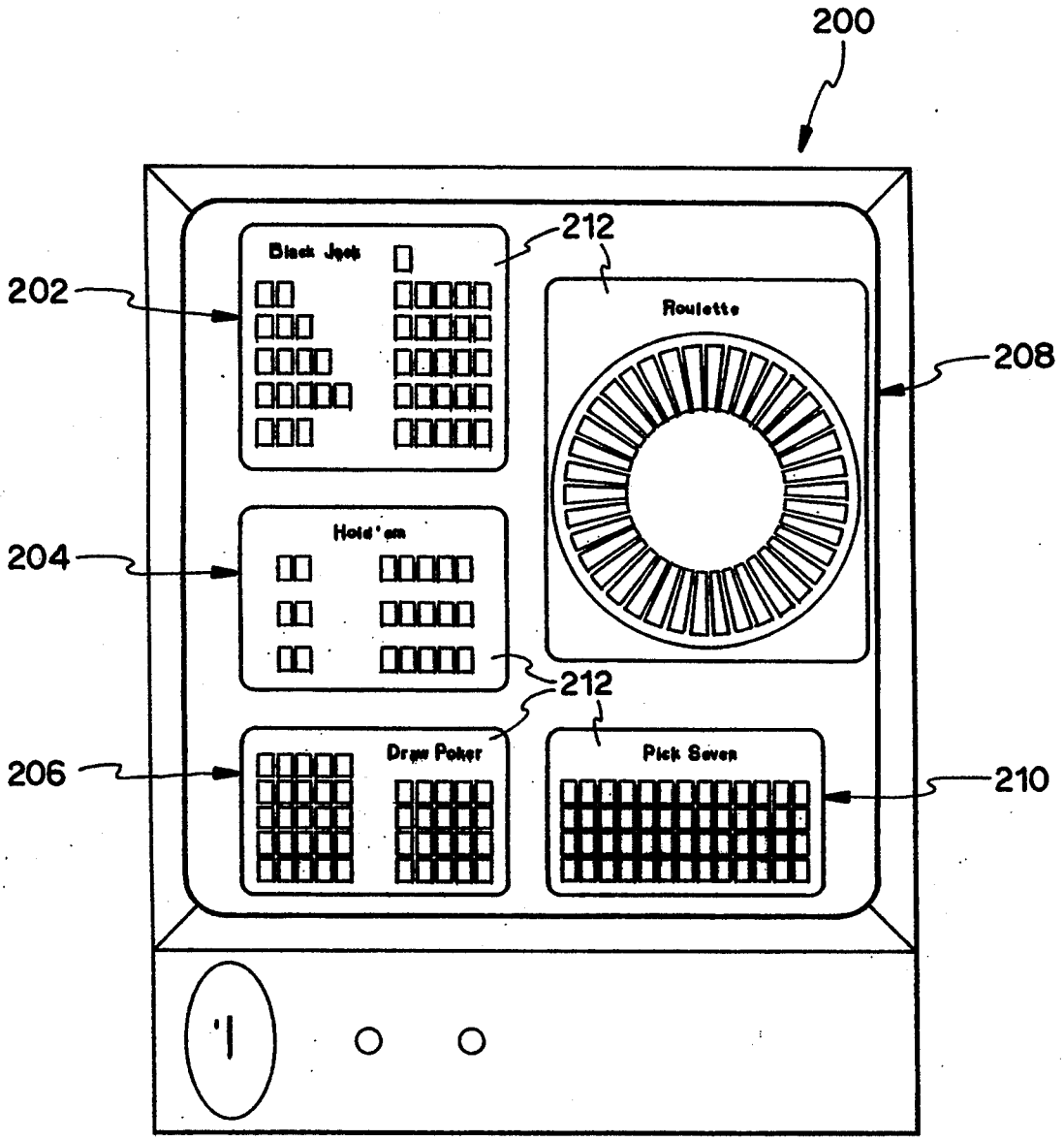
FIG. 10 shows the games of FIGS. 1–9 displayed on a video display terminal.

FIG. 10 shows a video display terminal 200 with each game 202, 204, 206, 208, 210 displayed on its screen 212. Although one terminal may be dedicated to one game, FIG. 10 displays the option of having all five games displayed on one terminal 200 so that the player may select any game from that terminal 200.

Preferably one of games 202, 204, 206, 208 and 210 is selected from the screen 212 by touching that portion of the screen 212 which will initiate the stored computer program for that game.

In each of the foregoing examples, it should be understood that the games may be played interchangeably as video format games or scratch-off tickets or pull tab games. While VDT, pull tabs and scratch-off formats have been used for casino type gambling games, the game simulations described above provide interchangeability between the three formats which is a highly desirable and important aspect of this invention.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A game simulating apparatus comprising:

a) a game display device;

b) said game display device having areas adapted for displaying sets of game representational values;

c) a first area for displaying a first of said sets and the second area for displaying a second of said sets;

d) the first set including a plurality of subsets of game values each of which is independently selectable and also correlatable with the second of said sets;

e) the subsets being a player's set which is to be correlated with the second set to determine whether the combination of representational values will produce a winning combination;

f) the representations in each of the sets being hidden from the player until it is revealed when the player makes a selection;

g) the selection being permanent and observable after a player makes a selection;

h) the second set of game representational values including a plurality of subsets, one for each subset of the first set;

i) each of the subsets of said second set being directly associated only with one of the subsets of the first set;

j) the representational values representing playing cards; and, k) the values in each succeeding subset of both the sets of representational values simulate progressive play from one correlated group of subsets to another by incorporating new card values in each subset of a succeeding correlated group of subsets as they would ordinarily be played in the card game simulated.

2. The game simulating apparatus as set forth in claim 1, wherein:

a) said game display device includes a scratch off card.

3. The game simulating apparatus as set forth in claim 1, wherein:

a) said game display device includes a video display screen.

4. The game simulating apparatus as set forth in claim 1, wherein:

a) said game display device includes a pull tab card.

5. The game simulating apparatus as set forth in claim 1, wherein:

a) said game display device includes areas adapted for displaying a simulated blackjack game.

6. The game simulating apparatus as set forth in claim 1, wherein:

a) said game display device includes areas adapted for displaying a simulated Hold'Em game.

7. The game simulating apparatus as set forth in claim 1, wherein:

a) said game display device includes areas adapted for displaying a simulated draw poker game.

* * * * *